US005129538A

United States Patent [19]

Bennett

[11] Patent Number: 5,129,538

[45] Date of Patent: Jul. 14, 1992

[54] CONTAINER, USABLE AS CASH DRAWER

[75] Inventor: George Bennett, Simi Valley, Calif.

[73] Assignee: Olympic Plastics, Inc., Los Angeles, Calif.

[21] Appl. No.: 783,784

[22] Filed: Oct. 29, 1991

[51] Int. Cl.[5] ..... B65D 43/20

[52] U.S. Cl. ..... 220/346; 220/345; 220/347; 220/377

[58] Field of Search ..... 220/346, 347, 377, 345

[56] References Cited

U.S. PATENT DOCUMENTS 4,405,057 9/1983 Stein ..... 220/346
4,470,518 9/1984 Stein ..... 220/346
4,884,733 12/1989 Geeves ..... 220/377 X

*Primary Examiner*—Stephen Marcus
*Assistant Examiner*—Paul A. Schwarz
*Attorney, Agent, or Firm*—William W. Haefliger

[57] ABSTRACT

A container comprising a receptacle having a bottom wall, upstanding side walls and upstanding end walls; a peripheral primary flange structure integral with the side and end walls, and projecting outwardly from upper extents of the side and end walls; a lid fitting over the receptacle, the flange structure providing rail structure to seat the lid as the lid slides endwise forwardly into receptacle closing position; and multiple interfitting and interlocking structure on the lid and on the primary flange structure to progressively interfit and lock the lid to the receptacle as the lid slides endwise into the receptacle closing position.

10 Claims, 5 Drawing Sheets

103
91
4
79
28
93
101
102
71
78
29
26
73
75
70
95
97
90
92
55
55a
30
72
94
99
25
74
77
26a
19
96
76
3
17
98
27
4
15
31a
22
20
32a
33a
35a
41
21
24
34a
14
21aa
68
12
18
21a
36a
69
18a
11
13
10
23
16
3
110

102
79
26
19
103
62
19a
63
15

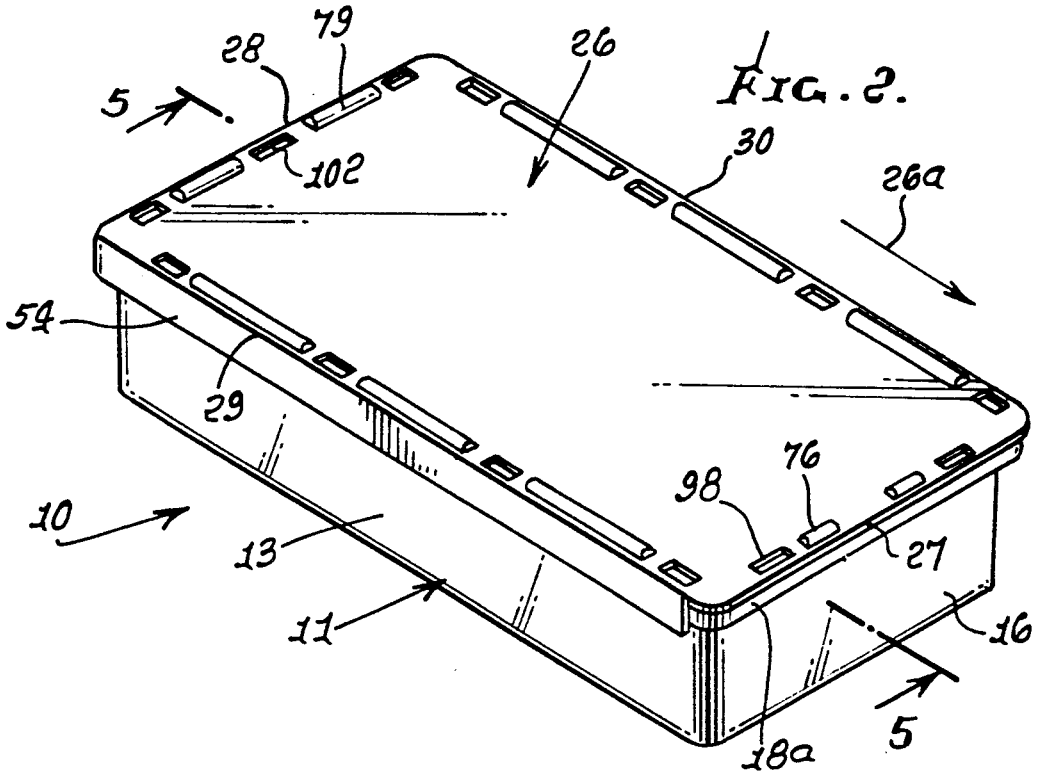
FIG. 2.
FIG. 10.
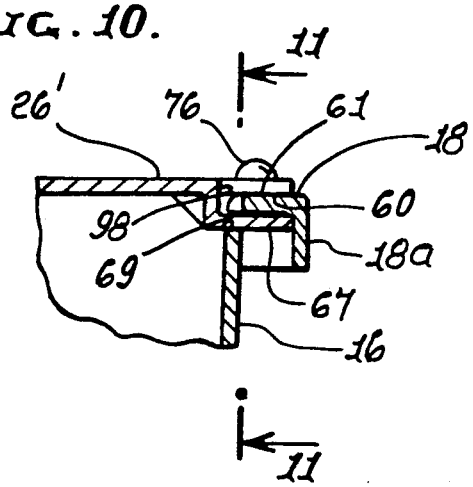
FIG. 11.
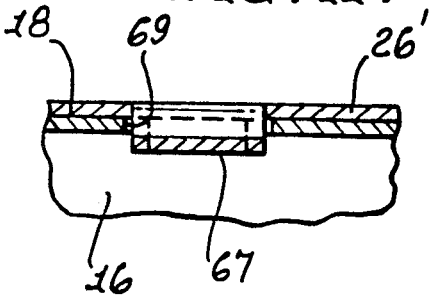
FIG. 14.
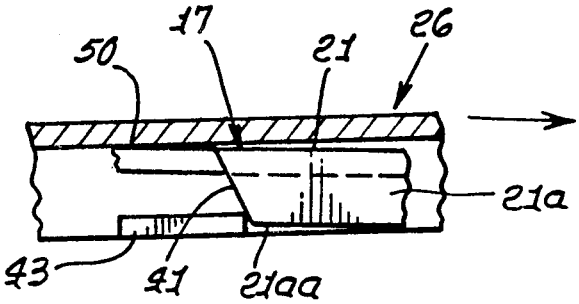

CONTAINER, USABLE AS CASH DRAWER

BACKGROUND OF THE INVENTION

This invention relates generally to the construction of rigid plastic containers having lids that slidably close; and more particularly concerns slide-to-lock improvements in such containers.

There is a need for the above type containers, as for use as cash boxes and the like. There is especially need for low cost, reliable, and strong containers of the above type, and which are self-locking.

SUMMARY OF THE INVENTION

It is a major object of the invention to provide an improved container that meets the described need. Basically, the improved container of the invention comprises:

a) a receptacle having a bottom wall, upstanding side walls and upstanding end walls, b) peripheral primary flange structure integral with the side and end walls, and projecting outwardly from upper extents of the side end walls, c) a lid fitting over the receptacle, the flange structure providing rail means to seat the lid as the lid slides endwise forwardly into receptacle closing position, d) and multiple interfitting and interlocking means on the lid and on the primary flange structure to progressively interfit and lock the lid to the receptacle as the lid slides endwise into the receptacle closing position.

Typically, and as will appear, the flange structure has first and second laterally elongated sections at opposite ends of the receptacle, and third and fourth longitudinally elongated sections at opposite sides of the receptacle, the interfitting and interlocking means including first, second, third, and fourth elements respectively associated with the first, second, third, and fourth flange extents. Certain of the interlocking elements integral with the lid may typically project downwardly to progressively underhang the primary flange structure, as the lid slides forwardly toward closing position; and such certain elements may project forwardly beneath the plane of the lid, at opposite sides and opposite ends thereof.

It is another object to provide flange structure which defines vertical through openings to downwardly pass a first group of such certain interlocking elements during forward sliding of the lid. In addition, secondary flange structure may be provided to be integral with the lid and to project downwardly to closely sidewardly interfit the primary flange structure for guiding the forward sliding of the lid. The described primary flange structure advantageously is integral with the receptacle side walls and has blocking shoulders located to block forward movement of a second group of the certain interlocking elements when the first group of the certain elements are poised over the through openings, the second group of the certain elements being freed for forward displacement after the first group of the certain elements have passed downwardly through the through openings.

Yet another object is to provide peripheral secondary flange structure integral with the lid and supporting the certain interlocking elements, the secondary flange structure bounding the primary flange structure to guide the forward sliding of the lid toward the closing position. Such secondary flange structure typically projects downwardly and longitudinally at outer sides of the third and fourth sections of the primary flange structure.

A further object includes the provision of cam surfaces on the receptacle and lid to frictionally interfere as the lid approaches the closing position, thereby to resist retraction of the closed lid relative to the receptacle.

These and other objects and advantages of the invention, as well as the details of an illustrative embodiment, will be more fully understood from the following specification and drawings, in which:

DRAWING DESCRIPTION

FIG. 2 is a perspective assembled view showing the receptacle and lid in closed position.

FIG. 10 is an enlarged section taken in elevation on lines 10—10 of FIG. 5;

FIG. 11 is a section taken in elevation on lines 11—11 of FIG. 10;

FIG. 14 is a diagrammatic view showing shoulder interference, longitudinally, between the lid and receptacle, at the time of downward interfitting of the lid onto the receptacle.

DETAILED DESCRIPTION

Figure 1:
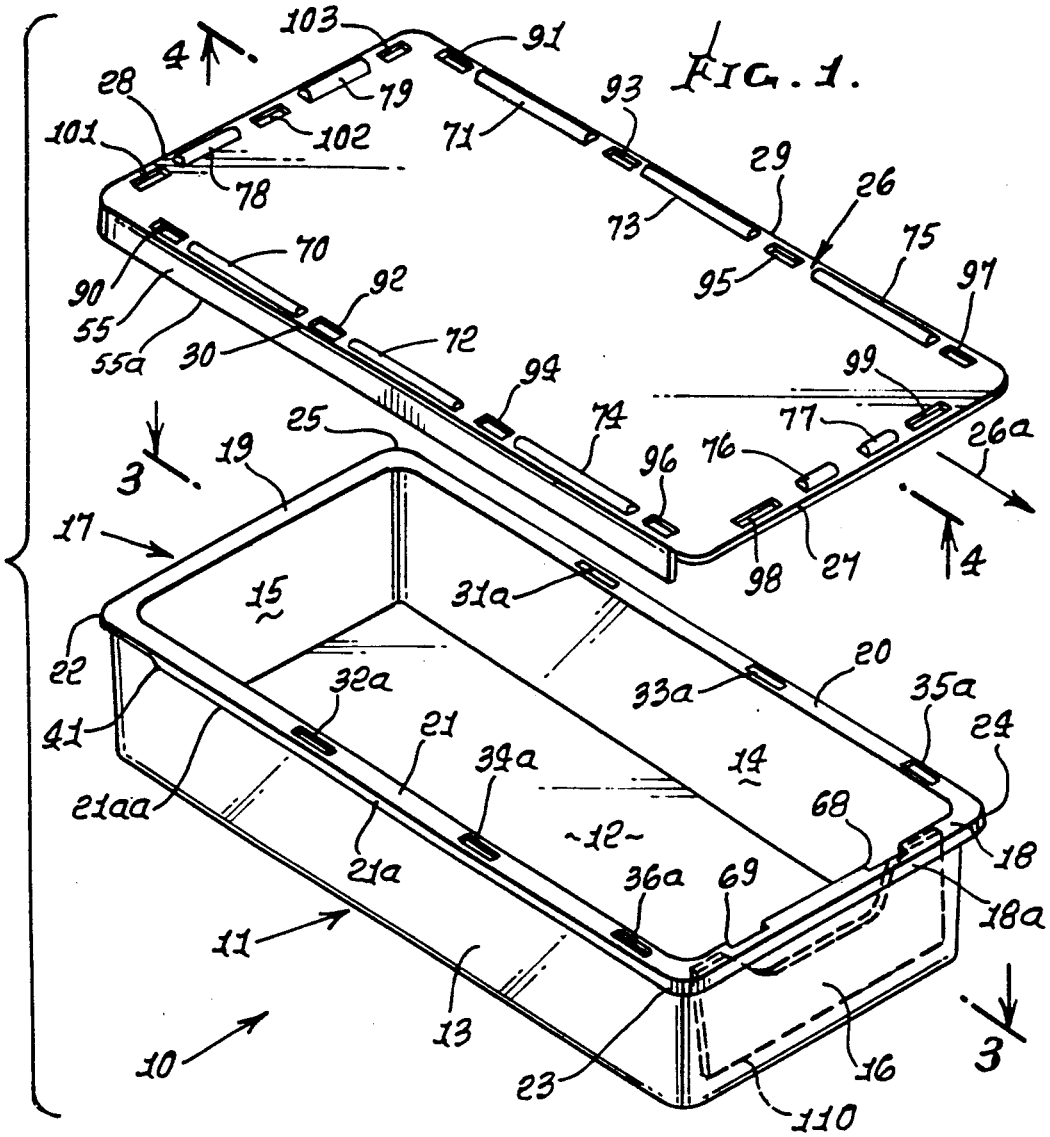
FIG. 1 is a perspective exploded view showing the receptacle and lid of the invention.
Figure 13:
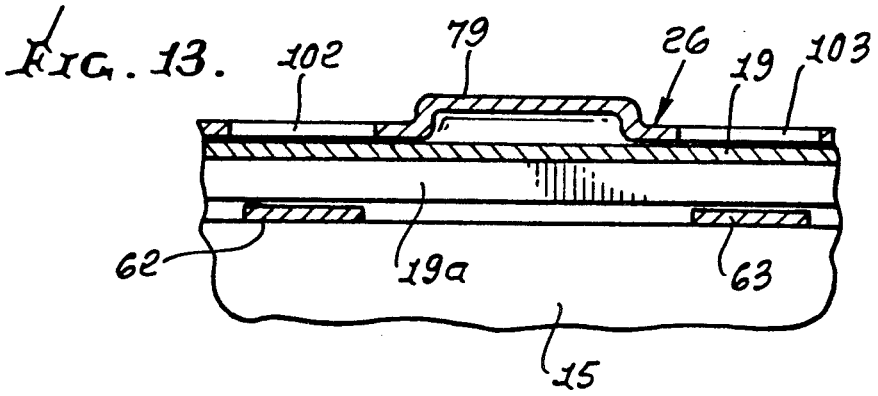
FIG. 13 is a section taken in elevation on lines 13—13 of FIG. 5.
Figure 3:
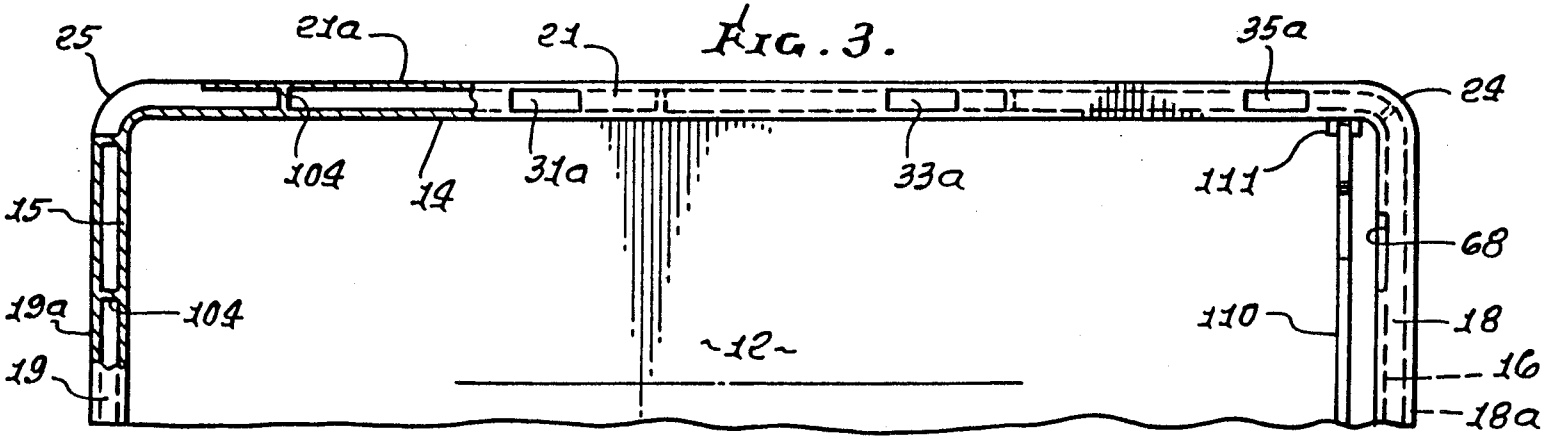
FIG. 3 is a fragmentary top plan view, partly in section, and taken on lines 3—3 of FIG. 1.
Figure 4:
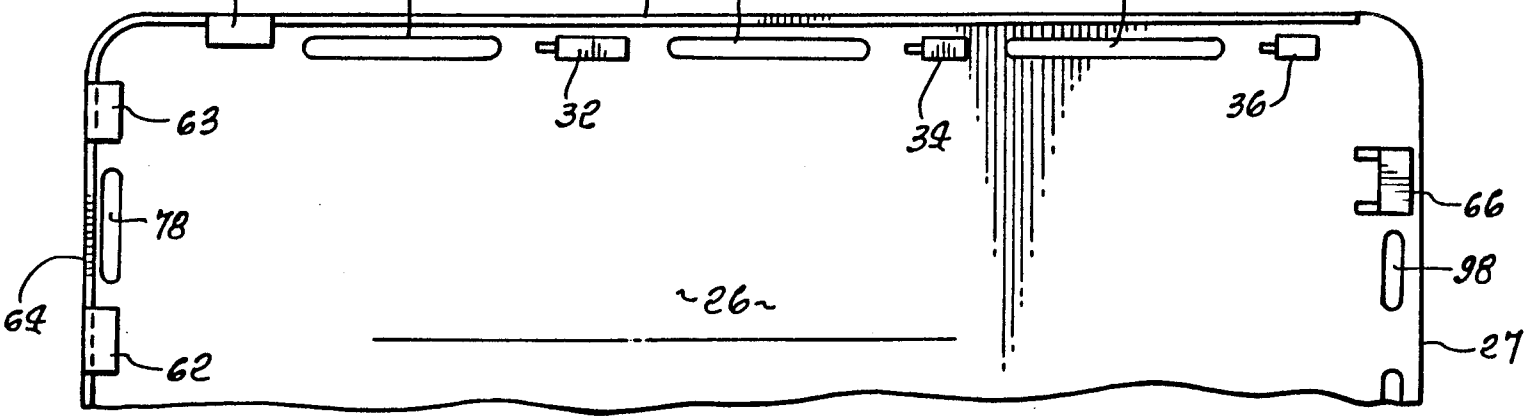
FIG. 4 is a fragmentary bottom plan view taken on lines 4—4 of FIG. 1.
Figure 5:
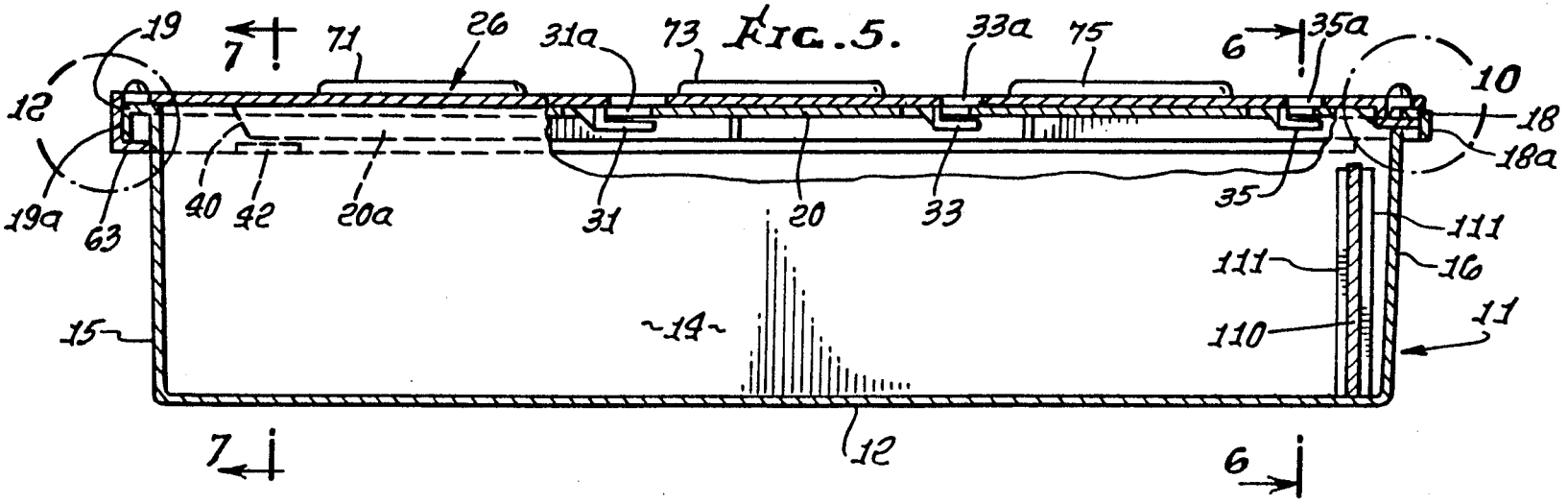
FIG. 5 is an elevation taken in section on lines 5—5 of FIG. 2.
Figure 12:
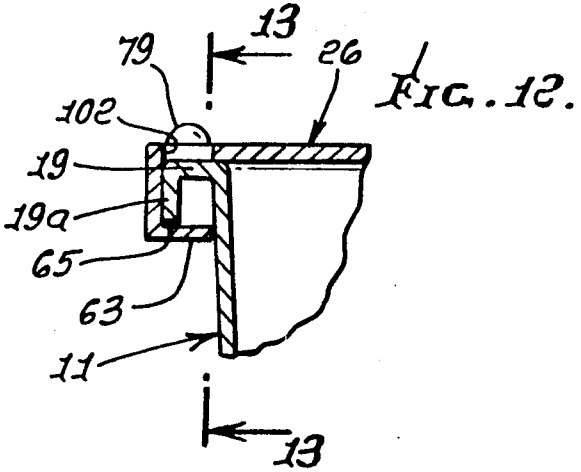
FIG. 12 is an enlarged section taken in elevation on lines 12—12 of FIG. 5.

In the drawings, a container 10 includes a receptacle 11 having a bottom wall 12, upstanding side walls 13 and 14, and upstanding end walls 15 and 16. Peripheral primary flange structure is integral with, and projects outwardly from, upper extents of the side and end walls. As shown, that flange structure 17 has first and second laterally elongated extents 18 and 19 at opposite ends of the receptacle, and third and fourth longitudinally elongated extents 20 and 21 at opposite sides of the receptacle. Those flange extents 18–21 have or define a flat, horizontal, upwardly facing co-planar surface. In addition, the flange structure has skirts **18*a*–21*a* integral with the outer ends of the flange extents 18–21, the skirts projecting downwardly in outwardly spaced relation to the receptacle walls 13–16, as shown. Curved corners are defined by the flanged extents and skirts at 22–25**.

The container also includes a lid 26 that fits over the receptacle, as seen in FIGS. 1 and 2, the primary flange structure providing rail means to seat the lid as the lid slides relatively endwise forwardly (in the direction of arrow 26a) toward and into receptacle closing position, as viewed in FIG. 2. The lid has forward and rearward ends 27 and 28 that extend laterally, and side edges 29 and 30 that extend longitudinally.

Multiple interfitting and interlocking means are provided on the lid 26 and on the primary flange structure 17 to progressively interfit and lock the lid to the receptacle as the lid slides endwise forwardly toward receptacle closing position, as referred to. Such interfitting and interlocking means typically include first, second, third, and fourth elements respectively associated with the first, second, third, and fourth flange extents 18–21. For example, note that certain of the interlocking elements 31 and 32, 33 and 34, and 35 and 36 project downwardly and also forwardly beneath the plane of the lid at opposite sides of the receptacle, to closely underhang the primary flange structure and progressively closely fit lockingly thereunder as the lid slides forwardly into closing position. Such elements 31–36 are hook-like.

In this regard, the primary flange structure defines vertical through openings to downwardly pass a first group of certain elements during the forward sliding of the lid. For example, note through openings 31a and 32a, 33a and 34a, 35a and 36a in FIG. 1 in the primary flange longitudinal extents 20 and 21, to downwardly pass the first group of the certain interlocking elements, i.e., hook-like elements 31–36 (opening 31a passes element 31; opening 32a passes element 32, etc.). Such openings are longer than the hook-like elements 31–36.

Figure 7:
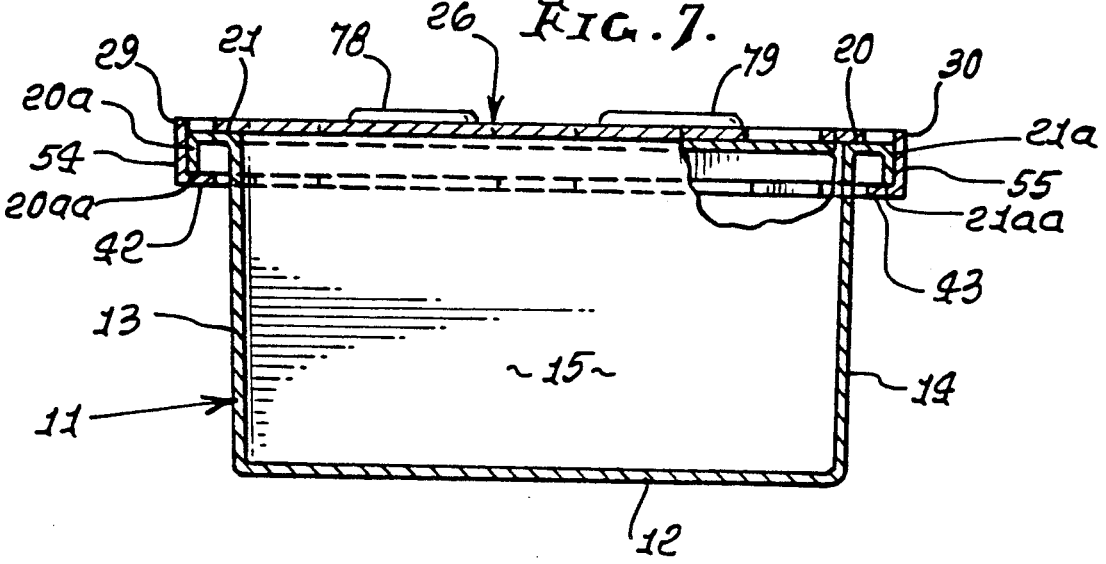
FIG. 7 is an elevation taken in section on lines 7—7 of FIG. 5.
Figure 8:
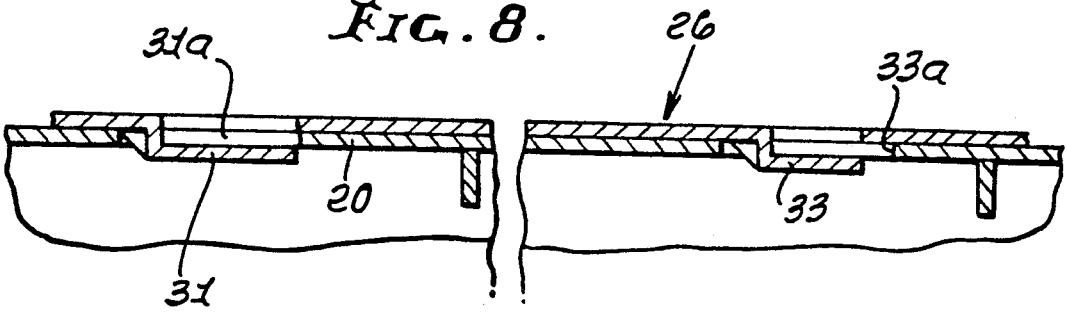
FIG. 8 is a fragmentary elevation showing downward passage of locking elements on the lid through openings in flange structure on the receptacle.
Figure 9:
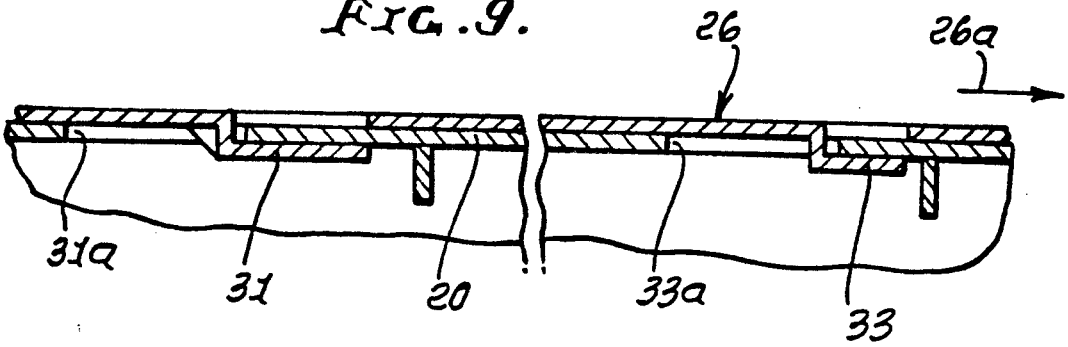
FIG. 9 is a view like FIG. 8 but showing forward displacement of the locking element on the lid relative to the flange structure on the receptacle at the time of closing of the lid.

In order that the lid may initially engage the receptacle and become initially oriented in forward sliding mode so that the elements 31–36 may become aligned or poised over the respective openings 31a–36a, additional structure is provided. In the example, the primary flange structure 17, integral with the receptacle side walls 13 and 14, has blocking shoulders located, for example, at 40 and 41 on skirts 20a and 21a, at opposite sides of the receptacle, to block forward movement of a second group (pair 42 and 43, for example) of the certain interlocking elements, when the first group 31–36 of elements become poised over the openings. Elements 42 and 43 are ledge-like, and project downwardly and laterally inwardly. See FIG. 7 showing element 43 on 55, and element 42 on 54. See also FIG. 14 showing element 43 engaging angled blocking shoulder 41 as the lid is being moved forwardly in upwardly angled mode, riding at 50 on the rail (flange 17) upper surface, rearwardly of the general location of the elements 42 and 43. The latter project horizontally inwardly from secondary flange structure including longitudinally extending flanges 54 and 55 projecting downwardly from opposite side edges 29 and 30 of the lid. See FIG. 7.

Inwardly hook-like elements 42 and 43 are at a lower level than the co-planar elements 31–36 that also lie inwardly of the side flanges 54 and 55. As the elements 31–36 drop downwardly through the openings 31a–36a, the two elements 42 and 43 pivot downwardly (50 is the fulcrum) below the levels of the angled blocking shoulders 40 and 41, to clear the lower edges 20aa and 21aa of the two skirts 20a and 21a, and to slidably and lockingly engage those edges as the lid moves to closed position. The forward and downward anglings of the two shoulders 40 and 41 assist downward pivoting and forward guided and sliding movement of the hook-like elements 42 and 43.

The secondary flanges 54 and 55 on the lid project downwardly and closely slidably sidewardly interfit the third and fourth sections 20a and 21a of the primary flange structure on the receptacle, for guiding forward sliding of the lid. Cam surfaces are provided on the receptacle and lid to frictionally interfere as the lid approaches closed position. This causes relative lifting of the lid and locking elements carried thereby, to increasingly frictionally grip (slidably) the adjacent under surfaces of the receptacle flange structure, to tighten the closing grip of the lid onto the receptacle. See for example shallow cam surfaces 60 and 61 on the forward ends of the lid and receptacle primary flange structure.

Additional locking elements are provided at 62 and 63 on the downwardly extending flange 64 at the rearward end of the lid, to project forwardly and move into position closely underhanging the lower edge 65 of rear flange section 19a on the receptacle, as the lid closes. See also additional locking elements 66 and 67 projecting forwardly from and beneath forward extents 26' of the lid, to move into position in slots 68 and 69 in the receptacle front wall 16, as the lid closes. Thus, the lid is locked to the receptacle at all four sides to ends thereof.

Figure 6:
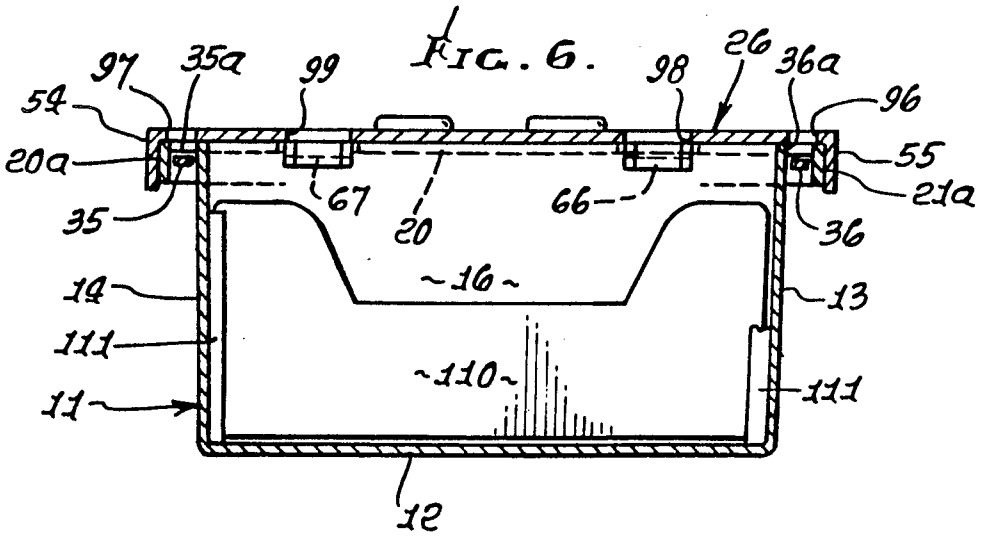
FIG. 6 is an elevation taken in section on lines 6—6 of FIG. 5.

Finally, strengthening ribbing is provided to upstand from the flange structure integral with the thin planar lid. Such ribbing includes longitudinally elongated sections 70 and 71, 72 and 73, and 74 and 75 overlying the primary flange sections 20 and 21 that extend longitudinally; and laterally elongated ribbing sections 76 and 77, and 78 and 79 overlying the primary flange sections 18 and 19 that extend laterally. Such ribs compensate for the weakening of the lid structure produced by recesses 90–103 formed upon plastic displacement during lid molding to form the hook-like elements described. Webs 104 associated with the receptacle walls and flanges 18a–21a stiffen the latter. The entire container may be molded from transparent synthetic resinous material. Dividers 110 may be assembled into the receptacle, and edge retained as at 111. See FIG. 6.

I claim:

1. A container, comprising in combination:

a) a receptacle having a bottom wall, upstanding side walls and upstanding end walls, b) a peripheral primary flange structure integral with said side and end walls, and projecting outwardly from upper extents of said side and end walls, c) a lid fitting over said receptacle, said primary flange structure providing rail means to seat the lid as the lid slides endwise forwardly into a receptacle closing position, d) and multiple interfitting and interlocking means on said lid and on the primary flange structure to progressively interfit and lock the lid to the receptacle as the lid slide endwise into said receptacle closing position, e) said primary flange structure being first and second laterally extended sections at opposite ends of the receptacle, and third and fourth longitudinally extended sections at opposite sides of the receptacle, said interfitting and interlocking means including first, second, third, and fourth elements respectively associated with said first, second, third, and fourth flange extents, f) certain of said interlocking elements integral with the lid projecting to progressively underhang said primary flange structure, as the lid slides forwardly toward said closing position, said certain elements projecting forwardly beneath the plane of the lid, at opposite sides and opposite ends thereof, g) said primary flange structure defining vertical through openings to downwardly pass a first group of said certain elements during said forward sliding of the lid, h) and said longitudinally extending sections having skirts defining angled blocking shoulders located to block forward movement of a second group of said certain elements when said first group of said certain elements are poised over said through openings, said second group of said certain elements being freed for forward displacement after said first group of said certain elements have passed downwardly through said through openings.

2. The combination of claim 1 including secondary flange structure integral with the lid and projecting downwardly to closely sidewardly interfit the primary flange structure for guiding said forward sliding of the lid.

3. The combination of claim 1 including peripheral secondary flange structure integral with the lid and supporting said certain interlocking elements, said secondary flange structure bounding said primary flange structure to guide said forward sliding of the lid forward said closing position.

4. The combination of claim 3 wherein said secondary flange structure projects downwardly and longitudinally at outer sides of said third and fourth sections of the primary flange structure.

5. The combination of claim 1 including cam surfaces on the receptacle and lid to frictionally interfere as the lid approaches said closing position, thereby to resist retraction of the closed lid relative to the receptacle.

6. The combination of claim 3 including ribbing upstanding from said lid.

7. The combination of claim 6 wherein said ribbing includes longitudinally elongated ribbing sections; and laterally elongated ribbing sections.

8. The combination of claim 1 including divider panels assembled into the container to interfit receptacle walls.

9. The combination of claim 1 wherein the receptacle and lid consist of transparent molded synthetic resin.

10. A container, comprising in combination:

a) a receptacle having a bottom wall, upstanding side walls and upstanding end walls, b) a peripheral primary flange structure integral with said side and end walls, and projecting outwardly from upper extents of said side and end walls, c) a lid fitting over said receptacle, said primary flange structure providing rail means to seat the lid as the lid slides endwise forwardly into receptacle closing position, d) and multiple interfitting and interlocking means on said lid and on the primary flange structure to progressively interfit and lock the lid to the receptacle as the lid slide endwise into said receptacle closing position, e) said primary flange structure being first and second laterally extended sections at opposite ends of the receptacle, and third and fourth longitudinally extended sections at opposite sides of the receptacle, said interfitting and interlocking means including first, second, third, and fourth elements respectively associated with said first, second, third, and fourth flange extents, f) certain of said interlocking elements integral with the lid projecting to progressively underhang said primary flange structure, as the lid slides forwardly toward said closing position, said certain elements projecting forwardly beneath the plane of the lid, at opposite sides and opposite ends thereof, g) said longitudinally extending sections having skirts defining angled blocking shoulders located to block forward movement of a second group of said certain elements when said first group of said certain elements are poised over said through openings, said second group of said certain elements being freed for forward displacement after said first group of said certain elements have passed downwardly through said through openings.

* * * * *